US008639155B2

(12) United States Patent
Kato

(10) Patent No.: US 8,639,155 B2
(45) Date of Patent: Jan. 28, 2014

(54) STOPPER FOR DEVELOPER FILLING PORT AND DEVELOPING DEVICE

(75) Inventor: Shuichi Kato, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 369 days.

(21) Appl. No.: 13/072,128

(22) Filed: Mar. 25, 2011

(65) Prior Publication Data

US 2011/0293320 A1 Dec. 1, 2011

(30) Foreign Application Priority Data

May 31, 2010 (JP) ..... 2010-123778

(51) Int. Cl.
*G03G 15/00* (2006.01)

(52) U.S. Cl.
USPC ..... 399/107; 399/106; 215/228; 215/273; 215/280; 220/212; 220/212.5; 220/254.1; 220/256.1; 220/787; 220/789; 220/791; 220/801

(58) Field of Classification Search
USPC ..... 399/106, 107; 215/228, 273, 280; 220/212, 212.5, 254.1, 256.1, 787, 220/789, 791, 801
See application file for complete search history.

(56) References Cited

U.S. PATENT DOCUMENTS

| | | | | |
|---|---|---|---|---|
| 3,703,975 | A * | 11/1972 | Wittemer | 220/212.5 |
| 6,150,608 | A | 11/2000 | Wambeke et al. | |
| 6,246,848 | B1 * | 6/2001 | Morinaga et al. | 399/106 |
| 6,935,527 | B1 * | 8/2005 | Brock | 220/254.1 |
| 6,966,342 | B2 | 11/2005 | Denham | |
| 2003/0178793 | A1 | 9/2003 | Denham | |
| 2005/0201776 | A1 * | 9/2005 | Askren et al. | 399/106 |

FOREIGN PATENT DOCUMENTS

| | | | |
|---|---|---|---|
| CN | 1217093 | A | 5/1999 |
| CN | 1427932 | A | 7/2003 |
| JP | H10-111596 | A | 4/1998 |
| JP | 2005-148343 | A | 6/2005 |

OTHER PUBLICATIONS

State Intellectual Property Office of the People'S Republic of China, The First Office Action for Chinese Patent Application No. 201110090004.X (counterpart Chinese patent application), mailed Dec. 25, 2012.

* cited by examiner

*Primary Examiner* — Ryan Walsh
(74) *Attorney, Agent, or Firm* — Baker Botts L.L.P.

(57) ABSTRACT

A stopper for plugging a developer filling port includes a stopper main body and a lock member engageable with the stopper main body. The stopper main body is configured to be fitted to the filling port and shaped like a tube with a bottom. The lock member has a rigidity greater than that of the stopper main body, the lock member engaged with the stopper main body serves to restrict deformation of the stopper main body. A developing device for use in an image forming apparatus includes the stopper configured as described above to be fitted to its developer filling port.

16 Claims, 8 Drawing Sheets

STOPPER FOR DEVELOPER FILLING PORT AND DEVELOPING DEVICE

CROSS-REFERENCE TO RELATED APPLICATION(S)

This application claims priority from Japanese Patent Application No. 2010-123778 filed on May 31, 2010, the disclosure of which is incorporated herein by reference in its entirety.

FIELD

Articles or apparatuses consistent with one or more aspects of the present invention relate to a stopper to be fitted to a filling port for developer, and a developing device including the stopper.

BACKGROUND

In view of the environmental friendliness, cartridges filled with developer for use in laser printers may be collected after use, refilled with developer, and recycled.

A stopper fitted to a filling port of a cartridge is designed variously to facilitate refilling of developer.

For example, a particular type of the stopper in a thin-walled structure having a bottom portion provided with a knob is known in the art wherein the knob is operative to be pulled out or pushed in so that one can deform the stopper between a high-pressure fitting state and a low-pressure fitting state to thereby smoothly open or close the filling port. Another type of the stopper having an engageable portion is also known in the art wherein a remover jig is engageable with this engageable portion so that the stopper fitted to the filling port can be removed easily.

However, these stoppers are configured to be easy to fit and remove, but their deformable configuration also allows the stoppers to inadvertently come off during transportation or storage.

There is a need to provide a stopper which is easy to fit and less prone to coming off during transportation or storage.

SUMMARY

In one aspect of the present invention, a stopper for plugging a developer filling port is provided. The stopper comprises a stopper main body and a lock member. The stopper main body is configured to be fitted to the filling port, the stopper main body being shaped like a tube with a bottom. The lock member has a rigidity greater than that of the stopper main body and is engageable with the stopper main body to restrict deformation of the stopper main body.

BRIEF DESCRIPTION OF THE DRAWINGS

The above aspect, its advantages and further features of the present invention will become more apparent by describing in detail illustrative, non-limiting embodiments thereof with reference to the accompanying drawings, in which.

DESCRIPTION OF EMBODIMENTS

First Embodiment

Figure 1:
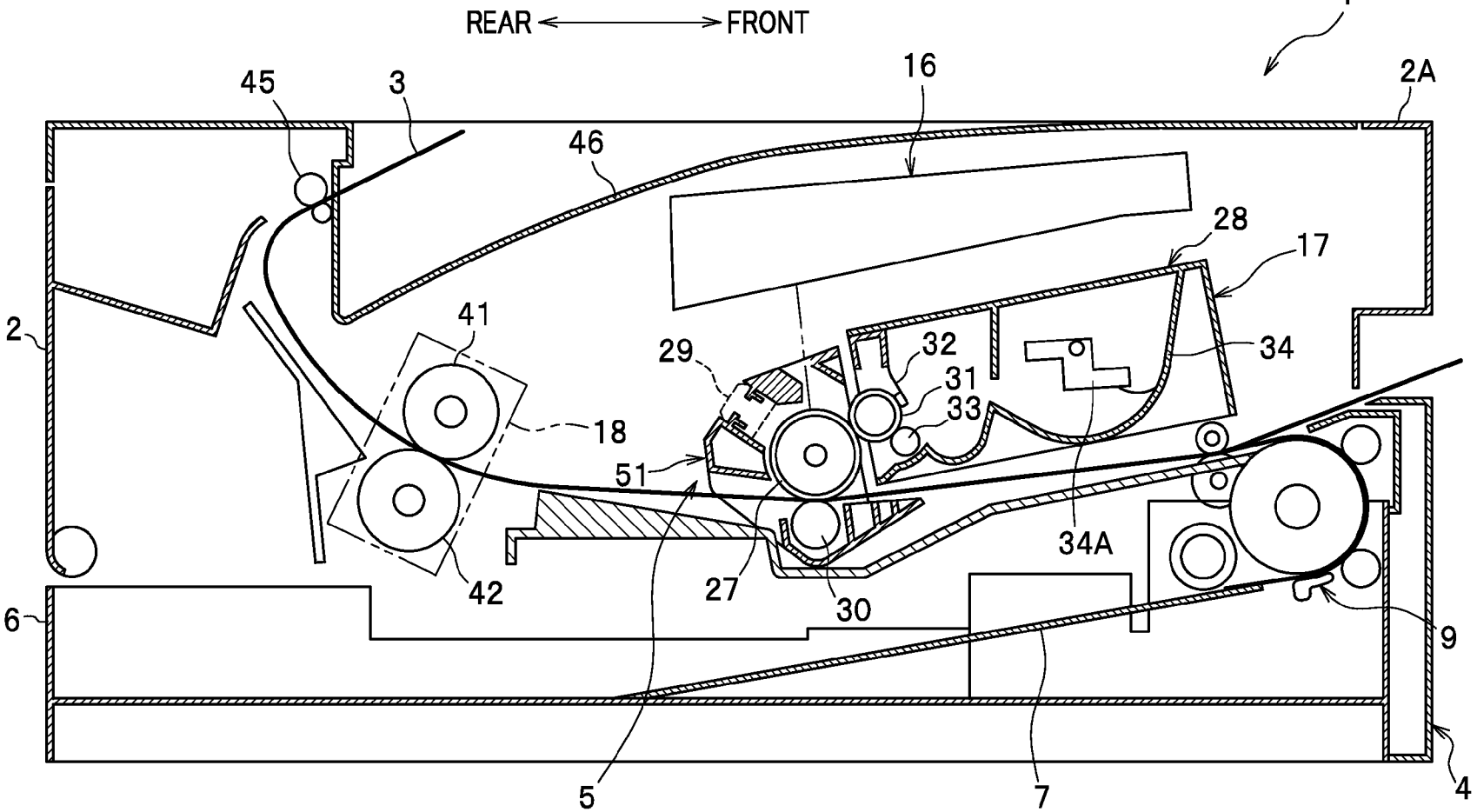
FIG. 1 is a schematic section of a laser printer which includes a development cartridge as one example of a developing device according to an exemplary embodiment.

A detailed description will be given of a first embodiment of the present invention with reference to the drawings. In the following description, a general setup of a laser printer 1 (image forming apparatus) including a development cartridge (developing device) will be described at the outset, and then features of a stopper for plugging a stopper filling port of the development cartridge as well as features of the development cartridge will be described in detail.

Hereinbelow, in describing the arrangement and operation of each component in the laser printer 1, the direction is designated as from the viewpoint of a user who is using (operating) the laser printer 1. To be more specific, in FIG. 1, the right-hand side of the drawing sheet corresponds to the "front" side of the printer, the left-hand side of the drawing sheet corresponds to the "rear" side of the printer, the front side of the drawing sheet corresponds to the "left" side of the printer, and the back side of the drawing sheet corresponds to the "right" side of the printer. Similarly, the direction of a line extending from top to bottom of the drawing sheet corresponds to the "vertical" or "up/down (upper/lower or top/bottom)" direction of the printer.

<General Setup of Laser Printer>

As shown in FIG. 1, the laser printer 1 comprises a body casing 2, and several components housed within the body casing 2 which principally include a sheet feeder unit 4 for feeding a sheet 3 (e.g., of paper) into the body casing 2, and an image forming unit 5 for forming an image on the sheet 3.

Sheet Feeder Unit

The sheet feeder unit 4, of a known structure, principally includes a sheet feed tray 6, a sheet pressure plate 7 and a sheet conveyor mechanism 9. In the sheet feeder unit 4, sheets 3 in the sheet feed tray 6 are pressed upwardly by the sheet pressure plate 7, and each sheet 3 separated from the others is conveyed by the sheet conveyor mechanism 9 into the image forming unit 5.

Image Forming Unit

The image forming unit 5 includes a scanner unit 16, a process cartridge 17, a fixing unit 18 and other components.

The scanner unit 16 includes a laser beam emitter, a polygon mirror, lenses, reflecting mirrors and other components, though not illustrated. In the scanner unit 16, a laser beam is caused to travel along a path indicated by alternate long and short dashed lines so that a peripheral surface of a photoconductor drum 27 is rapidly scanned and illuminated with the laser beam.

The process cartridge 17 is configured to be installable in and removable from the body casing 2 through an opening formed when a front cover 2A provided at the body casing 2 is swung open. The process cartridge 17 principally includes a development cartridge 28 and a drum unit 51.

The development cartridge 28 is configured to be attached to the drum unit 51 which is detachably attached to the body casing 2; alternatively, the development cartridge 28 is configured to be detachably attached to the drum unit 51 which is fixed to the body casing 2. The development cartridge 28 principally includes a developing roller 31, a doctor blade 32, a supply roller 33 and a toner hopper 34.

In the development cartridge 28, toner as one example of developer in the toner hopper 34 is agitated by an agitator 34A, and then supplied by the supply roller 33 onto the developing roller 31; in this process, the toner is positively charged by friction between the supply roller 33 and the developing roller 31. As the developing roller 31 rotates, the toner supplied onto the developing roller 31 passes through between the doctor blade 32 and the developing roller 31, so that a thin layer of toner having a predetermined thickness (which toner has been further charged by friction with the doctor blade 32) is carried on the developing roller 31. The structure of the development cartridge 28 will be described later in more detail.

The drum unit 51 principally includes a photoconductor drum 27 known in the art, a scorotron charger 29 and a transfer roller 30. In the drum unit 51, the peripheral surface of the photoconductor drum 27 is uniformly charged by the scorotron charger 29, and then exposed to a rapidly sweeping laser beam from the scanner unit 16. In this way, the electric potential of the exposed areas is lowered, so that an electrostatic latent image based on image data is formed on the peripheral surface of the photoconductor drum 27.

Subsequently, as the developing roller 31 rotates, toner carried on the developing roller 31 is supplied to the electrostatic latent image formed on the peripheral surface of the photoconductor drum 27, and a toner image is formed on the peripheral surface of the photoconductor drum 27. Thereafter, a sheet 3 is conveyed through between the photoconductor drum 27 and the transfer roller 30, so that the toner image carried on the photoconductor drum 27 is transferred onto the sheet 3.

The fixing unit 18 is a device having a known structure, and includes a heating roller 41 and a pressure roller 42. In the fixing unit 18, toner having been transferred on the sheet 3 is thermally fixed on the sheet 3 while passing through between the heating roller 41 and the pressure roller 42. The sheet 3 with the toner image thermally fixed thereon is ejected by a sheet output roller 45 onto a sheet output tray 46.

<Detailed Structure of Stopper>

Next, a detailed structure of a stopper 100 for plugging a filling port according to this embodiment will be described hereafter.

Figure 2:
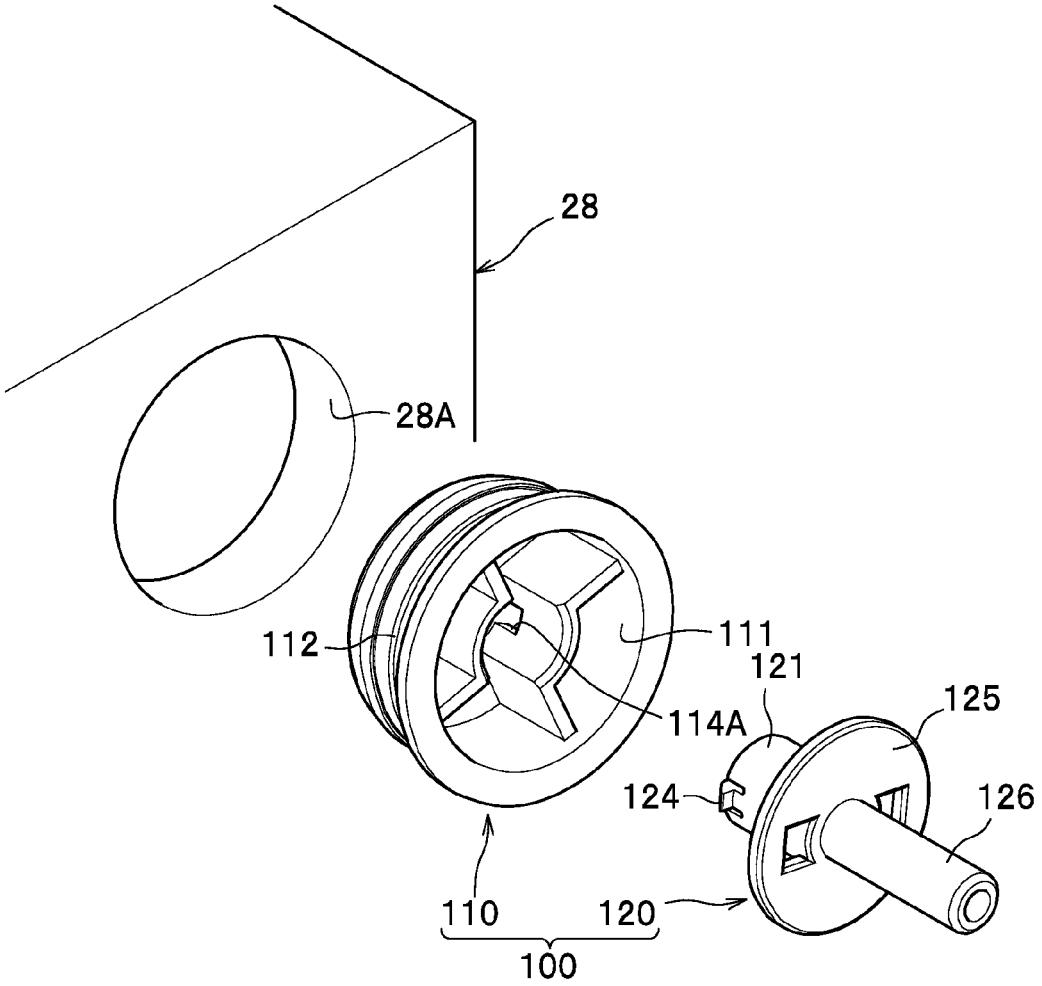
FIG. 2 is an exploded perspective view showing a stopper according to an exemplary embodiment.

As shown in FIG. 2, a filling port 28A for toner to be filled therethrough is formed at a sidewall of the development cartridge 28. The stopper 100 is fitted to this filling port 28A after filling of toner. The stopper 100 includes a stopper main body 110 configured to be fitted inside the filling port 28A in such a manner that the filling port 28A can be hermetically sealed, and a lock member 120 configured to be fitted to the stopper main body 110.

Figure 3A:
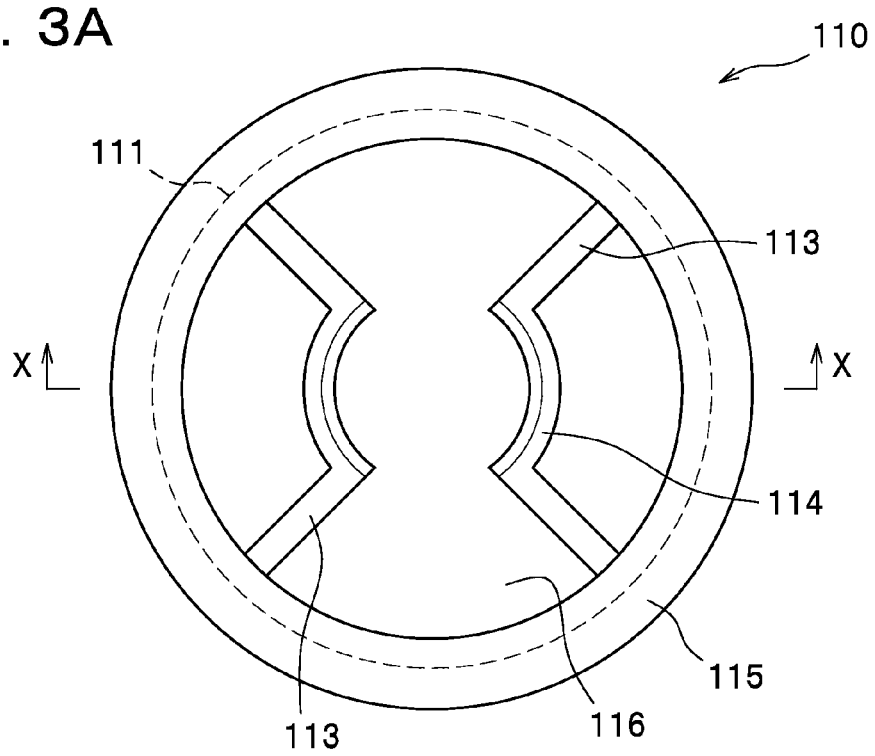
FIG. 3A is a front elevation of a stopper main body.
Figure 3B:
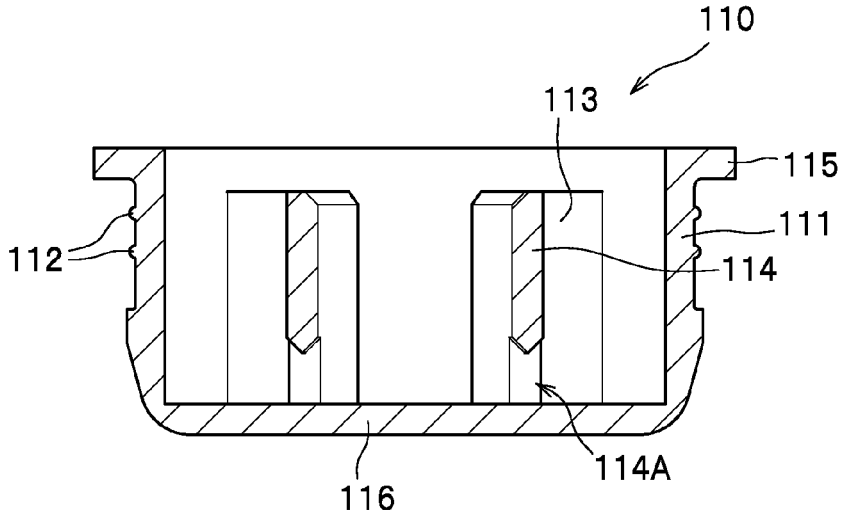
FIG. 3B is a sectional view taken along line X-X of FIG. 3A.

The stopper main body 110 is made of a plastic resin such as polypropylene, and is shaped, as shown in FIGS. 3A and 3B, like a cylindrical tube with a bottom; i.e., the stopper main body 110 has a structure including a cylindrical sidewall portion 111 and a bottom portion 116 with which one end of the sidewall portion 111 is closed.

As shown in FIG. 3B, a plurality of ribs 112 are provided on an outer peripheral surface of the sidewall portion 111. Each of the ribs 112 is arranged to extend around the sidewall portion 111 in a direction of circumference of a circular cross section of the sidewall portion 111, and configured to have a ridge defining an outside diameter larger than an inside diameter the filling port 28A. With these ribs 112, the sidewall portion 111 of the stopper main body 110 fitted to the filling port 28A comes in close contact, at these rigs 112, with the inner peripheral surface of the filling port 28A along their circumferential interface, so that leakage of toner through between the sidewall portion 111 and the filling port 28A is prevented.

A first flange portion 115 is provided at an open edge of the sidewall portion 111 of the stopper main body 110. This flange portion 115 has an outside diameter greater than the inside diameter of the filling port 28A. With this configuration, the first flange portion 115 of the stopper main body 110 comes in contact with the edge of the filling port 28A (i.e., the sidewall of the development cartridge 28 around the filling port 28A), so that the stopper main body 110 is lodged in the filling port 28A and the stopper 110 is prevented from getting into the development cartridge 28 through the filling port 28A.

As shown in FIG. 3A, four partition wall portions 113 and two arched portions 114 (connecting portions) are provided inside the sidewall portion 111.

Each of the four partition wall portions 113 is stood on, and jutting from, an inner surface of the bottom portion 116. The partition wall portions 113 are arranged to radially extend inward from positions, on an inner peripheral surface of the sidewall portion 111, spaced equidistantly in the direction of circumference of the sidewall portion 111.

Each of the two arched portions 114 is shaped like a segment of a circle the center of which coincides with the center of the circular bottom portion 116. The arched portions 114 are stood on, and jutting from, positions on the inner surface of the bottom portion 116 that are point-symmetric and opposite to each other. Of these two arched portions 114, one connects two adjacent partition wall portions 113 end to end, and the other connects the remaining two adjacent partition wall portions 113 end to end.

As shown in FIG. 3B, at a bottom end portion of each arched portion 114 located adjacent to the bottom portion 116, a hole 114A is provided with which one of engaging lugs 124 (engaging portions) of the lock member 120 which will be described later is engageable.

The lock member 120 is made of a material having a rigidity greater than that of the stopper main body 110, such as polystyrene, ABS resin, etc. As shown in FIG. 2, the lock member 120 principally includes a cylindrical portion 121, a second flange portion 125 and a boss portion 126.

Figure 4A:
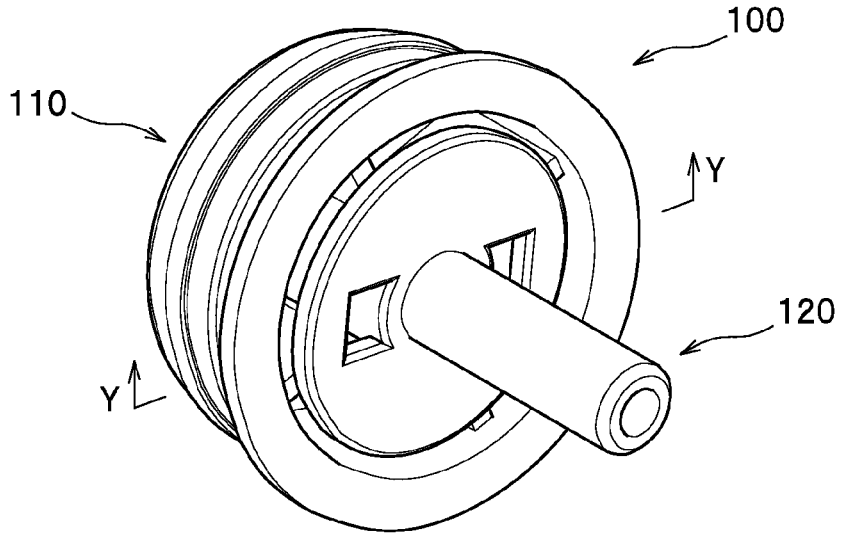
FIG. 4A is a perspective view of the stopper.
Figure 4B:
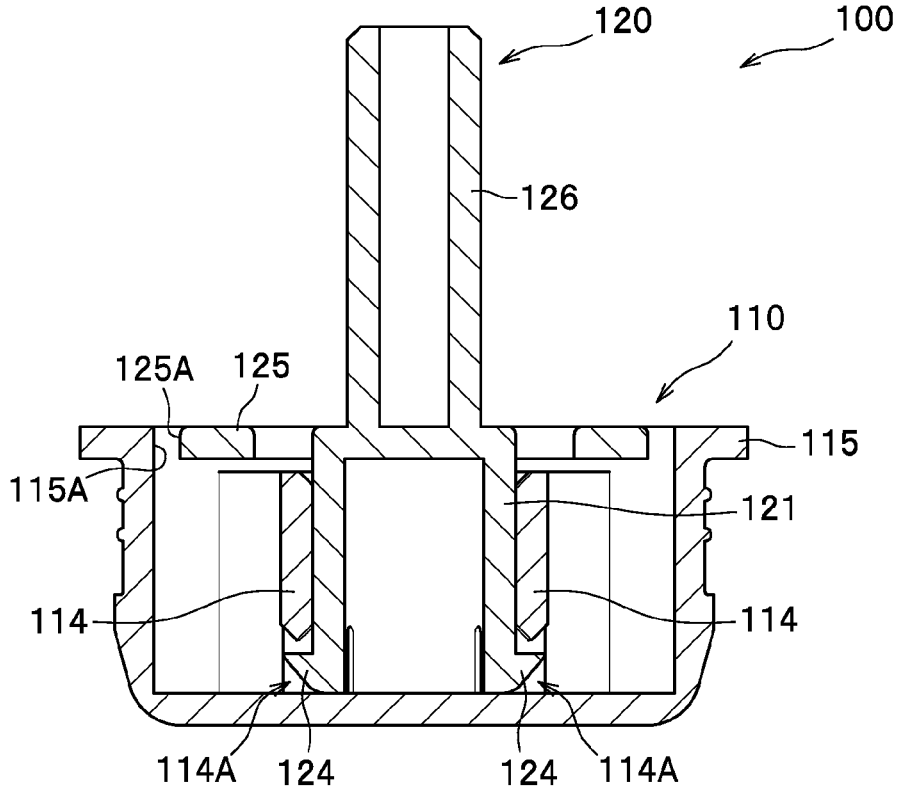
FIG. 4B is a sectional view taken along line Y-Y of FIG. 4A.

As shown in FIG. 4B, the outside diameter of the cylindrical portion 121 is set such that an outer peripheral surface of the cylindrical portion 121 abuts on inner peripheral surfaces of the two arched portions 114 when the lock member 120 is engaged with the stopper main body 110. At one end of the cylindrical portion 121 (opposite to the end at which the second flange portion 125 is provided), two engaging lugs 124 (engaging portions) configured to be engageable with the holes 114A of the arched portions 114 are provided at positions point-symmetric and opposite to each other, such that each engaging lug 124 of the lock member 120 engaged with the stopper main body 110 is located to face a corresponding hole 114 in the radial direction of the cylindrical portion 121.

The second flange portion 125 is provided at the end of the cylindrical portion 121 which is opposite to the end of the cylindrical portion 121 at which the engaging lugs 124 are provided. An outer end face 125A of the second flange portion 125 is disposed in proximity to an inner end face 115A of the first flange portion 115 of the stopper main body 110 when the lock member 120 is engaged with the stopper main body 110.

The boss portion 126 is a cylindrical member protruding outward from the second flange portion 125, that is, in a direction reverse to a direction of insertion of the stopper 100 fitted into the filling port 28A.

When the stopper 100 is fitted to the filling port 28A, the lock member 120 having the structure as described above is fitted into and engaged with the stopper main body 110, as shown in FIG. 4A. To be more specific, as shown in FIG. 4B, the cylindrical portion 121 of the lock member 120 is fitted between the two arched portions 114 of the stopper main body 110, and the engaging lugs 124 are engaged with the holes 114A of the arched portions 114.

<Detailed Structure of Developing Device>

Next, a detailed structure of the development cartridge 28 having the filling port 28A for toner, to which the stopper 100 is attached, according to this embodiment will be described hereafter.

Figure 5:
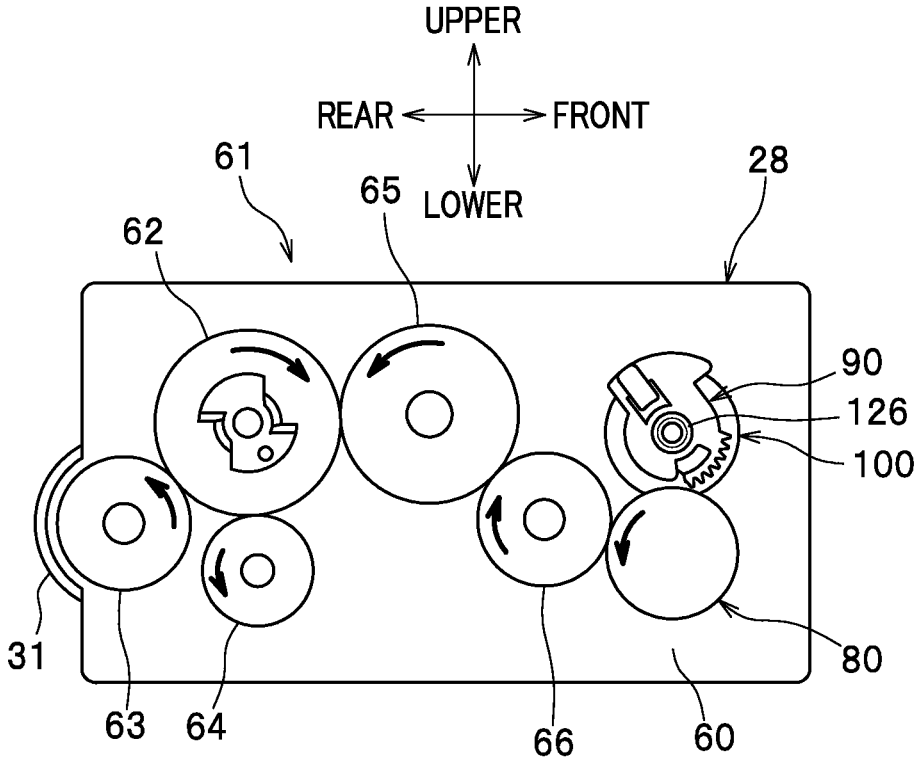
FIG. 5 is a side elevation of the development cartridge.

As shown in FIG. 5, the development cartridge 28 includes a cartridge main body 60 within which the developing roller 31 and other components as described above are housed. The cartridge main body 60 includes a gear train 61, a rotator driving gear 80, and a rotator 90 (gear).

The gear train 61 is an assembly of gears for transmitting a driving force inputted from outside to the developing roller 31, supply roller 33 and agitator 34A described above. To be more specific, the gear train 61 includes an input gear 62, a developing roller driving gear 63, a supply roller driving gear 64, an intermediate gear 65, and an agitator driving gear 66. The input gear 62 is disposed to receive a driving force from outside, and the developing roller driving gear 63 and the supply roller gear 64 are disposed to directly mesh with the input gear 62. The agitator driving gear 66 is disposed to mesh with the intermediate gear 65 which is in turn disposed to mesh with the input gear 62, so that the driving force is transmitted from the input gear 62 through the intermediate gear 65 to the agitator driving gear 66. The developing roller driving gear 63, the supply roller driving gear 64 and the agitator driving gear 66 are gears to drive the developing roller 31, the supply roller 33 and the agitator 34A, respectively, shown in FIG. 1, and provided integrally at one ends of the shafts of the developing roller 31, the supply roller 33 and the agitator 34A, respectively.

The rotator 90 is attached to the boss portion 126 of the stopper 100 fitted to the sidewall (where the filling port 28A is provided) of the development cartridge 28. Thus, the boss portion 126 serves as a shaft of the rotator 90.

The stopper 100 configured as described above operates and exerts several advantageous effects as follow.

Since the lock member 120 having a rigidity greater than that of the stopper main body 110 is engaged with the stopper main body, the inward deformation of the stopper main body 110 can be restricted.

To be more specific, the lock member 120 (the cylindrical portion 121) is fitted between the two arched portions 114 of the stopper main body 110, and thus the inward deformation (flexure) of the arched portions 114 is prevented. Once the lock member 120 is fitted to the stopper main body 110 in this way, the partition wall portions 113 serve as a support between the sidewall portion 111 and each arched portion 114, and thus the sidewall portions 111 become unable to bend inward, so that the stopper 100 becomes less prone to coming of from the filling port 28A.

Since the lock member 120 includes the engaging lugs 124, the lock member 120 can be fastened firmly to and prevented from inadvertently coming off from the stopper main body 110 with the help of the engaging lugs 124 kept in engagement with the holes 114A of the stopper main body 110.

Since the second flange portion 125 is provided, any accidental disengagement of the engaging lugs 124 from the holes 114A which could otherwise occur, for example, upon impact of a tool or the like inadvertently hit against the engaging lugs 124 can be prevented.

Since the lock member 120 includes the boss portion 126 protruding outward from the exterior surface of the lock member 120, this portion of the stopper 100 fitted to the filling port 28A of the development cartridge 28 can be utilized as the shaft of the rotator 90, and thus the necessity of providing the shaft of the rotator 90 at the sidewall of the development cartridge 28 can be obviated.

In the above-described embodiment, the stopper main body 110 includes four partition wall portions 113, but the number of the partition wall portions 113 which may be provided in a feasible manner is not limited to four. For example, the number of the partition wall portions 113 may be three, five or more.

In the above-described embodiment, the arched portions 114 included in the stopper main body 110 are configured to connect the adjacent partition wall portions 113 end to end, but the present invention is not limited to this particular embodiment. The arched portions 114 may be omitted, or the adjacent partition wall portions 113 may be connected at any positions other than their ends.

In the above-described embodiment, the holes 114 and the engaging lugs 124 are provided in the stopper main body 110 and the lock member 120, respectively, but the present invention is not limited to this particular embodiment. For example, the holes 114A and the engaging lugs 124 may be omitted, and the lock member 120 may be press fitted into the stopper main body 110.

In the above-described embodiment, the boss portion 126 of the stopper 100 is configured and arranged to be utilized as a shaft of a gear, such as the rotator 90, which is provided in the development cartridge 28. However, the present invention is not limited to this embodiment. For example, the boss portion of the stopper 100 may be configured and arranged to be utilized as a shaft of the intermediate gear 65 or a shaft of the rotator driving gear 80.

Alternatively, the boss portion 126 of the stopper 100 may be configured to include a hole for a screw to be screwed therein so that the boss portion 126 may be utilized as a boss for a screw to be tightened therein.

Figure 6A:
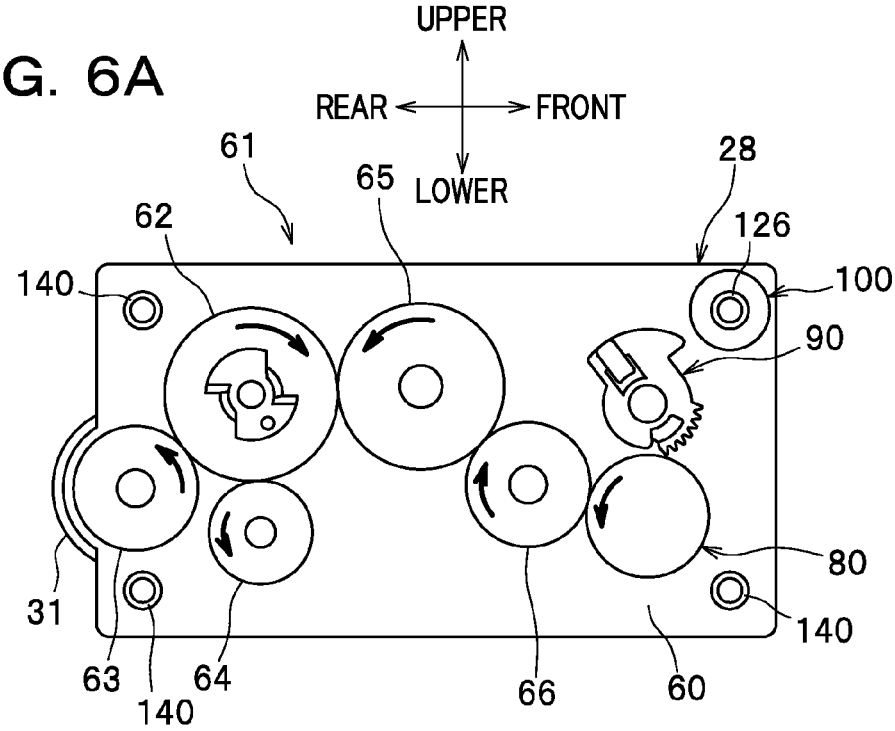
FIG. 6A is a side elevation of a modified form of the development cartridge with a cover member removed therefrom.
Figure 6B:
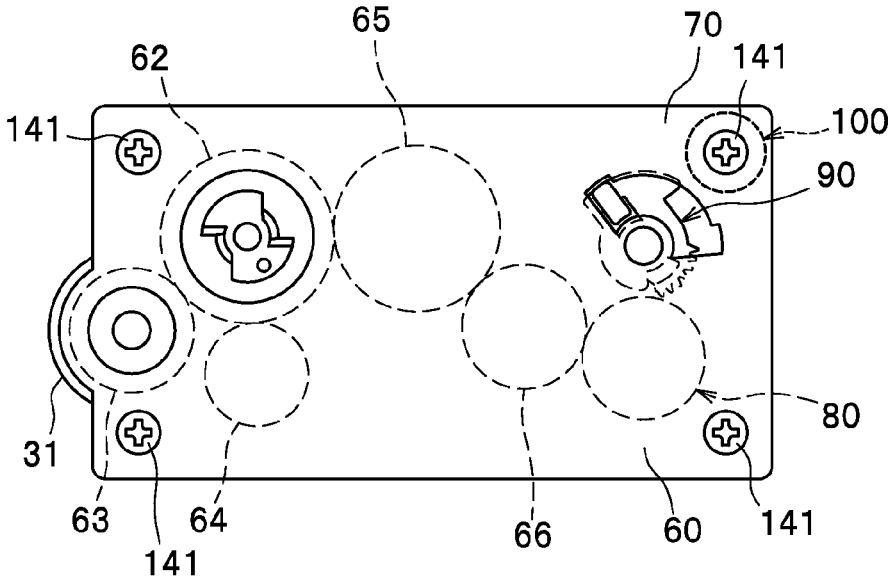
FIG. 6B is a side elevation of the development cartridge of FIG. 6A with the cover member attached thereto.

To be more specific, as shown in FIG. 6A, the development cartridge 28 includes three bosses 140 and one boss portion 126, wherein each boss 140 is protrusively formed on the sidewall of the development cartridge 28, and the boss portion 126 protrusively formed on an exterior surface of the lock member 120 engaged in the stopper main body 110 fitted in the filling port 28A at the sidewall of the development cartridge 28. A cover member 70 for covering the gear train 61 may be provided over the sidewall of the development cartridge 28, and screws 141 may be screwed in the holes provided in the bosses 140 and the boss portion 126 of the stopper 100, as shown in FIG. 6B, so that the cover member 70 can be secured to the sidewall of the development cartridge 28.

Figure 7:
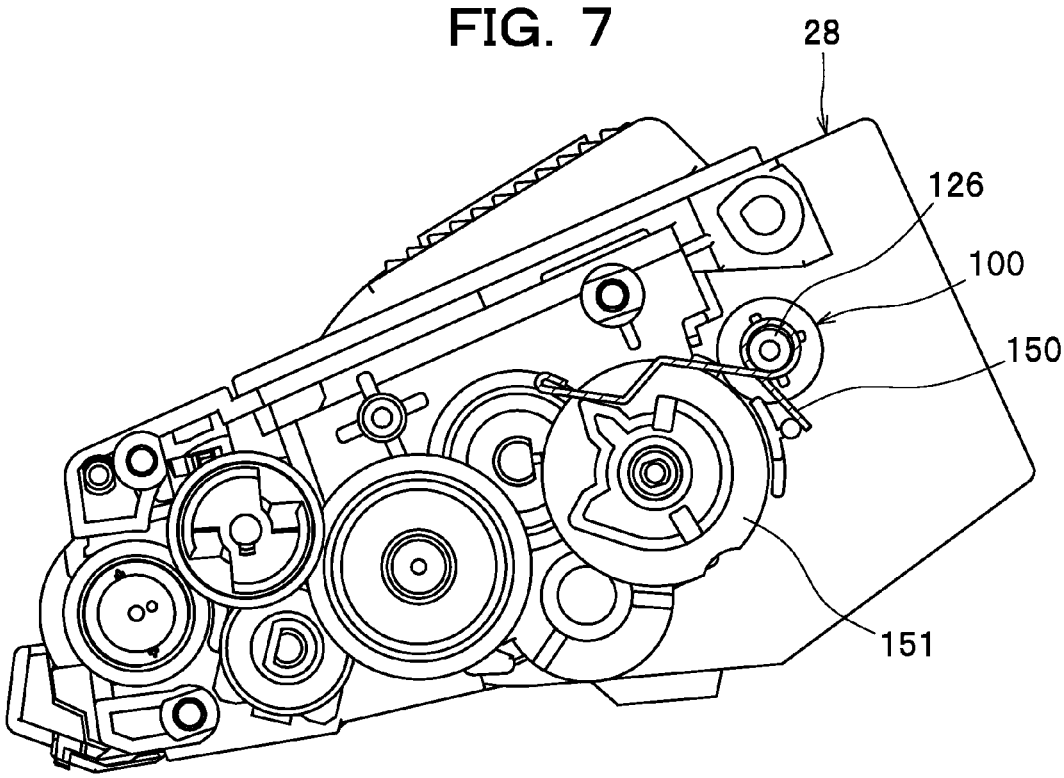
FIG. 7 is a side elevation showing another modification of the development cartridge.

Alternatively, as shown in FIG. 7, the boss portion 126 of the stopper 100 may be utilized as a shaft on which a torsion coil spring 150 for exerting a torque on the rotator 151 in one rotational direction is supported.

Alternatively, the boss portion 126 may be utilized as a pressure receiving portion such that the boss portion is in contact with and biased constantly by a pressing member 160 provided in the process cartridge 17.

Figure 8:
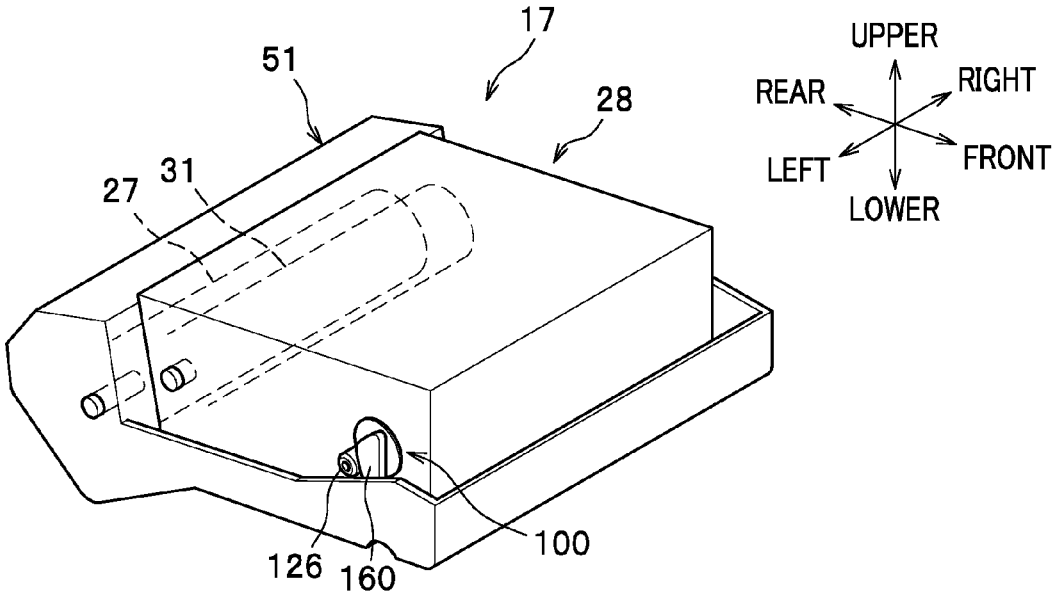
FIG. 8 is a perspective view showing yet another modification of the development cartridge.

For example, the developing roller 31 is pressed against the peripheral surface of the photoconductor drum 27 so that toner carried on the peripheral surface of the developing roller 31 is supplied to the electrostatic latent image formed on the photoconductor drum 27 to thereby form a toner image. FIG. 8 shows a specific structure and arrangement of the boss portion 126 utilized as a pressure receiving portion pressed by the pressing member 160 provided in the process cartridge 17. With this configuration, the pressing member 160 provided in the process cartridge 17 presses the boss portion 126, and the developing roller 31 is pressed onto the photoconductor drum 27. Another boss is provided on the right sidewall of the development cartridge 28, though not illustrated, and pressed by the pressing member 160. Accordingly, the developing roller 31 is pressed at the both end positions, and thus the developing roller 31 can be pressed to the photoconductor drum 27 with an evenly distributed force.

Second Embodiment

A detailed description will be given of a second embodiment of the present invention with reference to the drawings. As this embodiment is a modification of the first embodiment mainly in the structure of the stopper, the discussion will focus on the structural features of the stopper distinct from those of the first embodiment. The same components as those of the first embodiment are designated by the same reference characters, and a duplicate description thereof will be omitted.

Figure 9A:
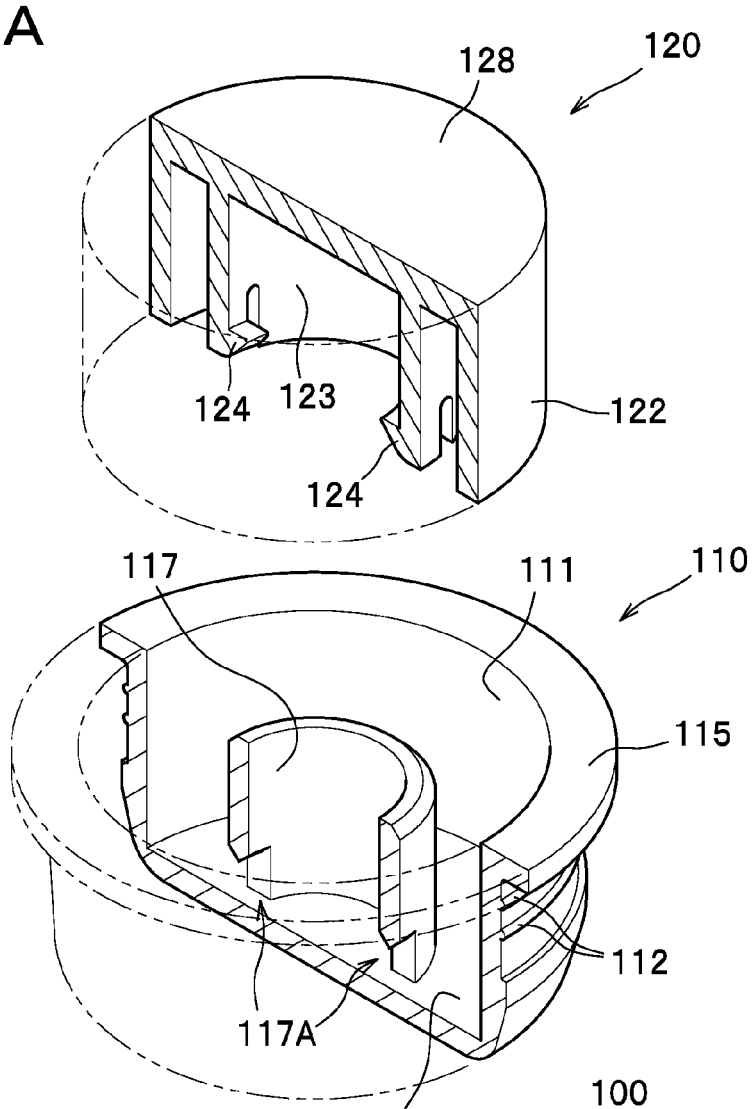
FIG. 9A is an exploded perspective view of a modified form of the stopper.
Figure 9B:
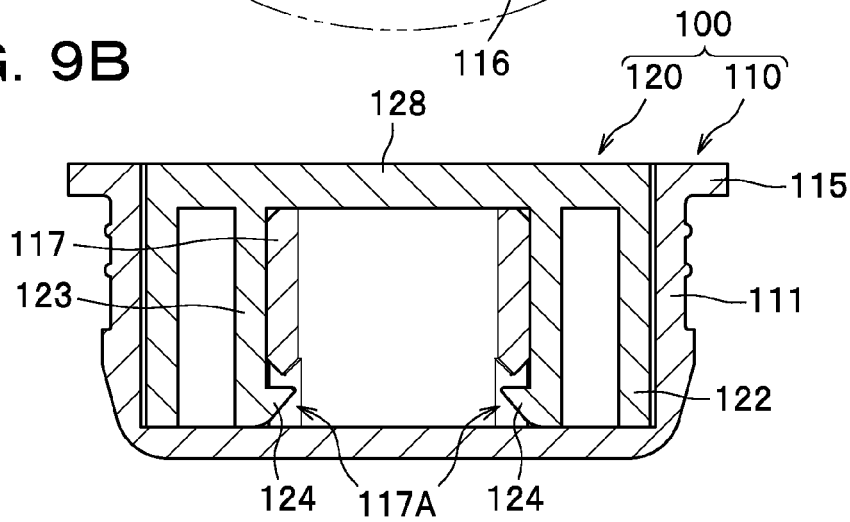
FIG. 9B is a sectional view of the stopper of FIG. 9A

As shown in FIGS. 9A and 9B, the stopper 100 includes a stopper main body 110 and a lock member 120.

As shown in FIG. 9A, the stopper main body 110 is shaped like a cylindrical tube with a bottom; i.e., the stopper main body 110 includes a cylindrical sidewall portion 111, and a bottom portion 116 with which one end of the sidewall portion 111 is closed. The stopper main body 110 further includes a cylindrical tubular wall portion 117 provided on and protruding from the bottom portion 116 inside the sidewall portion 111. At a bottom end of the tubular wall portion 117 adjacent to the bottom portion 116, two holes 117A are formed at positions point-symmetric and opposite to each other.

The lock member 120 is made of a resin or the like which is of a rigidity greater than that of the stopper main body 110. The lock member 120 includes a first cylindrical tubular portion 122, and a bottom portion 128 with which one end of the first cylindrical tubular portion 122 is closed. The lock member 120 further includes a second cylindrical tubular portion 123 disposed inside the first cylindrical tubular portion 122. At an open end of the second cylindrical tubular portion 123, two engaging lugs 124 are formed at positions point-symmetric and opposite to each other.

As shown in FIG. 9B, the outer peripheral surface of the first cylindrical tubular portion 122 of the lock member 120 engaged with the stopper main body 110 faces the inner peripheral surface of the sidewall portion 111 of the stopper main body 110. The inner peripheral surface of the second cylindrical tubular portion 123 of the lock member 120 engaged with the stopper main body 110 abuts on the outer peripheral surface of the tubular wall portion 117 of the stopper main body 110. In this state, the engaging lugs 124 engage with the holes 117A.

An exterior surface of the bottom portion 128 of the lock member 120 fitted in (engaged with) the stopper main body 110 is flush with an open edge of the stopper main body 110.

The stopper 100 configured as described above operates and exerts several advantageous effects as follow.

Since the lock member 120 having a rigidity greater than that of the stopper main body 110 is fitted in a gap between the sidewall portion 111 and the tubular wall portion 117 of the stopper main body 110, the inward deformation of the stopper main body 110 (sidewall portion 111) can be restricted. This configuration serves to make the stopper 100 less prone to coming off from the filling port 28A.

Since the exterior surface of the lock member 120 engaged with the stopper main body 110 is flush with the open edge of the stopper main body 110, a surface with a large area astride the stopper 100 such that a tape or the like can be stuck thereon can be provided on the development cartridge 28.

In the second embodiment described above, the stopper main body 110 and the lock member 120 are designed such that the inner peripheral surface of the second cylindrical tubular portion 123 of the lock member 120 fitted in the stopper main body 110 abuts on the outer peripheral surface of the tubular wall portion 117 of the stopper main body 110. However, the present invention is not limited to this specific configuration. For example, the stopper main body 110 and the lock member 120 may be designed such that the outer peripheral surface of the second cylindrical tubular portion 123 of the lock member 120 abuts on the inner peripheral surface of the tubular portion 117 of the stopper main body 110.

In the second embodiment described above, the stopper main body 110 and the lock member 120 are designed such that the exterior surface (of the bottom portion 128) of the lock member 120 fitted in the stopper main body 110 is flush with the open edge of sidewall portion 111 of the stopper main body 110. However, the present invention is not limited to this specific configuration. For example, the lock member 120 may be configured to protrude outward beyond the exterior surface (i.e., the open edge of the sidewall portion 111) of the stopper main body 110.

Although the illustrative embodiments of the present invention has been described above, the present invention is not limited to the above-described embodiments. Various modifications and changes may be made to the specific structures and arrangement without departing from the scope of the present invention.

In the above-described embodiments, the stopper main body 110 is illustrated to have the shape of a cylindrical tube with a bottom but the present invention is not limited to this specific shape of the stopper main body 110. The shape of the stopper main body 110 may be modified variously as long as its outer peripheral surface is configured to contact with the filling port 28A in a manner that allows the stopper 100 to hermetically seal the filling port 28A when the stopper main body 110 is fitted to the filling port 28A and the lock member 120 is engaged with the stopper main body 110. For example, the stopper main body 110 may be shaped like a tube with a polygonal bottom.

In the above-described embodiment, the stopper 100 and the development cartridge 28 including the stopper 100 are described as being included in the laser printer 1 by way of example. The present invention is however not limited to this example. Alternatively, the stopper for plugging a developer filling port and a developing device in which a developer filling port is plugged with the stopper consistent with the present invention may be used in any other image forming apparatus such as photocopiers, multifunction peripherals, etc.

The invention claimed is:

1. A stopper for plugging a developer filling port, comprising:

a stopper main body configured to be fitted to the filling port, the stopper main body being shaped like a tube with a bottom; and a lock member having a rigidity greater than that of the stopper main body, the lock member being engageable with the stopper main body to restrict deformation of the stopper main body, wherein the stopper main body comprises a wall extending from the bottom of the stopper main body inside the stopper main body, and the lock member comprises an engaging lug configured to engage with a hole provided in the wall of the stopper main body.

2. The stopper according to claim 1, wherein the stopper main body includes:

a sidewall portion having an inner peripheral surface and an outer peripheral surface, the outer peripheral surface being configured to contact with the filling port in a manner that allows the stopper to hermetically seal the filling port;

three or more partition wall portions radially extending inward from the inner peripheral surface of the sidewall portion; and a connecting portion connecting two adjacent partition wall portions, the connecting portion being stood on the bottom of the stopper main body, wherein the lock member has a peripheral surface configured to contact with the connecting portion, thereby preventing the connecting portion from being deformed inwardly.

3. The stopper according to claim 2, wherein at least one other connecting portion is provided such that each of all pairs of adjacent partition wall portions except at least one pair of the adjacent partition wall portions is connected by a corresponding connecting portion.

4. The stopper according to claim 2, wherein the lock member includes an engaging portion engageable with the connecting portion.

5. The stopper according to claim 1, wherein the stopper main body includes:

a sidewall portion having an outer peripheral surface configured to contact with the filling port in a manner that allows the stopper to hermetically seal the filling port; and a tubular wall portion provided inside the sidewall portion in a manner that allows the lock member to be fitted in a gap between the sidewall portion and the tubular wall portion of the stopper main body.

6. The stopper according to claim 5, wherein the lock member includes an engaging portion engageable with the tubular wall portion.

7. The stopper according to claim 1, wherein the stopper main body includes a sidewall portion having an outer peripheral surface configured to contact with the filling port in a manner that allows the stopper to hermetically seal the filling port, the sidewall portion further having at least one rib provided on the outer peripheral surface and extending around the stopper main body.

8. The stopper according to claim 1, wherein the lock member includes a boss portion protruding outward from an exterior surface of the lock member.

9. A stopper according to claim 1, wherein the lock member engaged with the stopper main body protrudes outward beyond an exterior surface of the stopper main body.

10. The stopper according to claim 1 wherein the lock member has an exterior surface such that the exterior surface of the lock member engaged with the stopper main body is flush with an open edge of the stopper main body.

11. A developing device for use in an image forming apparatus, comprising a stopper according to claim 1, wherein the lock member includes a boss portion protruding outward from an exterior surface of the lock member.

12. The developing device according to claim 11, further comprising a gear train configured to transmit a driving force inputted from outside, wherein the boss portion serving as a shaft of a gear in the gear train, or a shaft on which a coil spring is supported.

13. The developing device according to claim 11, further comprising:

a gear train configured to transmit a driving force inputted from outside; and a cover member configured to cover the gear train;

wherein the boss portion including a hole for use in fastening the cover member to the developing device by a screw.

14. The developing device according to claim 11, wherein the boss portion serving as a pressure receiving portion such that the boss portion of the stopper fitted to the filling port of the developing device installed in the image forming apparatus is in contact with and biased constantly by a pressing member provided in the image forming apparatus.

15. A stopper for plugging a developer filling port, comprising:

a stopper main body configured to be fitted to the filling port, the stopper main body being shaped like a tube with a bottom; and a lock member having a rigidity greater than that of the stopper main body, the lock member being engageable with the stopper main body to restrict deformation of the stopper main body, wherein the stopper main body includes:

a sidewall portion having an outer peripheral surface configured to contact with the filling port in a manner that allows the stopper to hermetically seal the filling port; and a first flange portion provided at an open edge of the sidewall portion.

16. The stopper according to claim 15, wherein the lock member includes a second flange portion having an outer end face such that the outer end face of the second flange portion of the lock member engaged with the stopper main body is disposed in proximity to an inner end face of the first flange portion of the stopper main body.

* * * * *